US008147229B2

(12) United States Patent
Gopinathan

(10) Patent No.: US 8,147,229 B2
(45) Date of Patent: Apr. 3, 2012

(54) MOTOR-COMPRESSOR UNIT MOUNTING ARRANGEMENT FOR COMPRESSORS

(75) Inventor: Anil Gopinathan, Clinton, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 951 days.

(21) Appl. No.: 11/742,779

(22) Filed: May 1, 2007

(65) Prior Publication Data

US 2007/0201996 A1 Aug. 30, 2007

Related U.S. Application Data

(63) Continuation-in-part of application No. 11/039,552, filed on Jan. 20, 2005, now abandoned.

(51) Int. Cl.
*F01C 1/02* (2006.01)
*F03C 2/00* (2006.01)

(52) U.S. Cl. ..... 418/55.1; 418/55.4; 418/55.5; 418/57; 418/270

(58) Field of Classification Search ..... 418/55.1–55.6, 418/57, 270
See application file for complete search history.

(56) References Cited

U.S. PATENT DOCUMENTS

| | | | | | |
|---|---|---|---|---|---|
| 3,788,778 | A | | 1/1974 | Miller | |
| 3,872,562 | A | | 3/1975 | Pestel | |
| 4,431,356 | A | | 2/1984 | Lassota | |
| 4,545,742 | A | | 10/1985 | Schaefer | |
| 4,552,518 | A | * | 11/1985 | Utter | 418/55.6 |
| 4,609,334 | A | * | 9/1986 | Muir et al. | 418/55.2 |
| 4,767,293 | A | * | 8/1988 | Caillat et al. | 418/55.3 |
| 4,940,396 | A | * | 7/1990 | Shimizu et al. | 417/410.5 |
| 5,042,150 | A | | 8/1991 | Fraser, Jr. | |
| 5,064,356 | A | | 11/1991 | Horn | |
| 5,188,520 | A | | 2/1993 | Nakamura et al. | |
| 5,215,451 | A | | 6/1993 | Hara et al. | |
| 5,224,849 | A | * | 7/1993 | Forni | 418/55.5 |
| 5,228,196 | A | | 7/1993 | Hara et al. | |
| 5,247,736 | A | | 9/1993 | Fraser, Jr. et al. | |
| 5,328,340 | A | | 7/1994 | Hara et al. | |
| 5,407,335 | A | | 4/1995 | Caillat et al. | |
| 5,411,384 | A | * | 5/1995 | Bass et al. | 418/55.1 |
| 5,474,433 | A | * | 12/1995 | Chang et al. | 418/55.4 |
| 5,533,875 | A | * | 7/1996 | Crum et al. | 418/55.6 |
| 5,772,411 | A | | 6/1998 | Crum et al. | |
| 5,873,710 | A | | 2/1999 | Tucker | |
| 6,027,321 | A | * | 2/2000 | Shim et al. | 418/1 |
| 6,056,523 | A | * | 5/2000 | Won et al. | 418/15 |
| 6,193,484 | B1 | | 2/2001 | Hahn et al. | |
| 6,220,839 | B1 | * | 4/2001 | Sheridan et al. | 418/55.1 |
| 6,280,154 | B1 | * | 8/2001 | Clendenin et al. | 417/410.5 |
| 6,422,842 | B2 | * | 7/2002 | Sheridan et al. | 418/55.1 |
| 6,687,992 | B2 | | 2/2004 | Quesada et al. | |
| 2004/0047754 | A1 | | 3/2004 | Gopinathan | |
| 2006/0159579 | A1 | | 7/2006 | Skinner et al. | |

* cited by examiner

*Primary Examiner* — Theresa Trieu
(74) *Attorney, Agent, or Firm* — Faegre Baker Daniels LLP

(57) ABSTRACT

A method of assembling a compressor, including assembling, first as a subassembly external of the compressor housing, portions of the motor-compressor unit, including a crankcase, mount brackets, stator, outboard bearing assembly, and drive shaft. Thereafter, the motor-compressor unit subassembly is inserted into a first end of the housing, and the housing is shrink-fit around the subassembly. The mount brackets may then be welded to the interior surface of the housing. Once the mount brackets are welded to the housing, the remainder of the components of the motor-compressor unit, including the orbiting scroll member, the Oldham coupling, and the fixed scroll member, are then assembled to the motor-compressor unit subassembly and the housing through a second end of the housing opposite the first end, followed by welding the top and bottom caps to the housing.

6 Claims, 5 Drawing Sheets

MOTOR-COMPRESSOR UNIT MOUNTING ARRANGEMENT FOR COMPRESSORS

CROSS-REFERENCE TO RELATED APPLICATION

This application is a continuation-in-part of U.S. patent application Ser. No. 11/039,552, entitled MOTOR-COMPRESSOR UNIT MOUNTING ARRANGEMENT FOR COMPRESSORS, filed on Jan. 20, 2005, the entire disclosure of which is expressly incorporated by reference herein.

BACKGROUND

1. Field of the Invention

The present invention relates to compressors, and in particular, to a mounting arrangement for mounting a motor-compressor unit within the housing of a compressor, such as a scroll compressor, for example.

2. Description of the Related Art

Known compressors, including scroll compressors, typically have a three-part housing, including a generally cylindrical main housing, and end caps attached to opposite ends of the main housing. A separator plate within the housing divides the housing interior into a suction chamber and a discharge chamber. In a typical low-side compressor, a motor-compressor unit is mounted within the housing and positioned within the suction chamber. The motor-compressor unit is operable to compress a working fluid at suction pressure, which enters the suction chamber through a suction port of the housing, to a discharge pressure, and then discharge the compressed working fluid into the discharge chamber. The working fluid then exits the housing through a discharge port in the housing.

In a scroll compressor, the motor-compressor unit includes a non-orbiting scroll member which is fixed with respect to the housing, and an orbiting scroll member which includes an involute wrap in meshing engagement with the involute wrap of the non-orbiting scroll member. The orbiting scroll member is driven by a motor for orbital movement to define a plurality of variable-volume working pockets between the wraps of the non-orbiting and orbiting scroll members to compress the working fluid.

The motor-compressor unit of a scroll compressor also typically includes a crankcase to which the non-orbiting scroll member is attached, as well as an outboard bearing, a motor including a stator and a rotor, and a drive shaft fixed to the rotor. The drive shaft is rotatably supported at its opposite ends by the crankcase and the outboard bearing, and drives the orbiting scroll member. The crankcase is attached to the housing by a shrink or press fit, or by welding. Similarly, the stator and the outboard bearing are also attached to the housing by a shrink or press fit, or by welding. In a vertical compressor, the weight of the components of the motor-compressor unit, including the crankcase, stator and outboard bearing, is supported by the attachment of the foregoing components to the housing.

Although the foregoing mounting arrangement typically provides adequate support for the motor-compressor unit within the compressor, a disadvantage with same is that attaching each of the crankcase, the stator, and the outboard bearing to the compressor housing increases the difficulty of assembling the compressor and is labor-intensive.

What is needed is a mounting arrangement for mounting a motor-compressor unit within a compressor housing which is an improvement over the foregoing.

SUMMARY

The present invention provides a mounting arrangement for the motor-compressor unit of a compressor, and a method of assembling a compressor, particularly a scroll compressor. A fixed scroll member is attached to the compressor housing by an overlap between an annular shoulder on the fixed scroll member and the upper end of the housing. A crankcase is attached to, and supported from, the fixed scroll member by a plurality of fasteners, and the crankcase rotatably supports a drive shaft and an orbiting scroll member. The drive shaft is fixed to a rotor disposed within a stator, and an end of the drive shaft opposite the crankcase is rotatably supported by an outboard bearing assembly. A plurality of mount brackets are secured to an interior surface of the housing, and a plurality of fasteners extend through the outboard bearing, the stator, and the mount brackets, and are threaded into the crankcase to rigidly secure the foregoing components together. The weight of the stator and the outboard bearing assembly is substantially supported by the fixed scroll member and crankcase via the fasteners, and the engagement of the fasteners with the stator and the mount brackets rotationally fixes the position of the stator to counter the rotational torque of the motor during operation of the compressor.

To assemble the compressor, portions of the motor-compressor unit, including the crankcase, mount brackets, stator, outboard bearing assembly, and drive shaft, may be assembled first as a subassembly externally of the housing. Thereafter, the motor-compressor unit subassembly is inserted into a first end of the housing, followed by welding the mount brackets to the interior surface of the housing to secure the motor-compressor unit subassembly within the housing. The remainder of the components of the motor-compressor unit, including the orbiting scroll member, the Oldham coupling, and the fixed scroll member, are then assembled to the motor-compressor unit subassembly and the housing through a second end of the housing opposite the first end, followed by welding the top and bottom caps to the housing.

In another exemplary embodiment, to assemble the compressor, portions of the motor-compressor unit, including the crankcase, mount brackets, stator, outboard bearing assembly, and drive shaft, may be assembled first as a subassembly externally of the housing. Thereafter, the motor-compressor unit subassembly is inserted into a first end of the housing, and the housing is shrink-fit around the subassembly. The mount brackets may then be welded to the interior surface of the housing. Once the mount brackets are welded to the housing, the remainder of the components of the motor-compressor unit, including the orbiting scroll member, the Oldham coupling, and the fixed scroll member, are then assembled to the motor-compressor unit subassembly and the housing through a second end of the housing opposite the first end, followed by welding the top and bottom caps to the housing.

In one form thereof, the present invention provides a compressor, including a housing; a crankcase one of directly and indirectly fixedly connected to the housing; at least one mount bracket secured to an interior surface of the housing; a stator spaced inwardly from the interior surface of the housing; and at least one fastener connecting the stator and the crankcase, the fastener extending through the stator and the at least one mount bracket, whereby the weight of the stator is substantially supported by the crankcase and the engagement between the fasteners and the mount brackets rotationally fixes the position of the stator.

In another form thereof, the present invention provides a compressor, including a housing; a crankcase one of directly and indirectly fixedly connected to the housing; a stator spaced inwardly from an interior surface of the housing; at least one fastener connecting the stator and the crankcase, the crankcase substantially supporting the weight of the stator via the at least one fastener; and means cooperating between the housing and the at least one fastener for substantially fixing rotationally the position of the stator.

In a further form thereof, the present invention provides a scroll compressor, including a housing; a first scroll member one of directly and indirectly fixedly connected to the housing and including a base plate and a first wrap extending from the base plate; a crankcase connected to the first scroll member; a stator, rotor, and drive shaft assembly, the stator spaced inwardly from the interior surface of the housing, and an end of the drive shaft rotationally supported by the crankcase; a second scroll member coupled to the drive shaft for orbital movement, the second scroll member including a second wrap intermeshed with the first wrap; a plurality of mount brackets secured to an interior surface of the housing in spaced relation with respect to one another; and a plurality of fasteners connecting the stator and the crankcase, the fasteners extending through the stator and respective the mount brackets, whereby the weight of the stator is supported by the crankcase and the engagement between the fasteners and the mount brackets rotationally fixes the position of the stator.

In a still further form thereof, the present invention provides a method of assembling a compressor, including the steps of assembling a subassembly by connecting a stator, at least one mount bracket, and a crankcase to one another with at least one fastener, the at least one fastener passing through the stator and a respective mount bracket; inserting the subassembly into a first end of a housing; and then securing the at least one mount bracket to the housing.

In a still further form thereof, the present invention provides a compressor, including a housing; a motor including a stator and a rotor positioned within the housing; a crankcase one of directly and indirectly fixedly connected to the housing; an outboard bearing assembly positioned within the housing; a mount bracket secured to an interior surface of the housing, the mount bracket positioned adjacent the outboard bearing assembly; and at least one fastener connecting the outboard bearing assembly and the stator, the fastener extending through the at least one mount bracket and the outboard bearing assembly, whereby the mount bracket rotationally fixes the position of the stator.

In a still further form thereof, the present invention provides a scroll compressor, including a housing; a first scroll member one of directly and indirectly fixedly connected to the housing and including a base plate and a first wrap extending from the base plate; a crankcase connected to the first scroll member; a stator, rotor, and drive shaft assembly, an end of the drive shaft rotationally supported by the crankcase; a second scroll member coupled to the drive shaft for orbital movement, the second scroll member including a second wrap intermeshed with the first wrap; an outboard bearing assembly positioned within the housing; a plurality of mount brackets secured to an interior surface of the housing, the mount brackets positioned adjacent the outboard bearing assembly; and a plurality of fasteners connecting the outboard bearing assembly and the stator, the fasteners extending through the outboard bearing assembly and respective the mount brackets, whereby the weight of the stator is supported by the outboard bearing assembly and the engagement between the fasteners and the mount brackets rotationally fixes the position of the stator.

In a still further form thereof, the present invention provides a method of assembling a compressor, including the steps of assembling a subassembly by connecting a stator, at least one mount bracket, an outboard bearing assembly, and a crankcase to one another with at least one fastener, the at least one fastener passing through the outboard bearing assembly and a respective mount bracket; inserting the subassembly into a first end of a housing; shrink-fitting the housing to the subassembly; and then securing the at least one mount bracket to the housing.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention and such exemplifications are not to be construed as limiting the scope of the invention in any manner.

DETAILED DESCRIPTION

Figure 1:
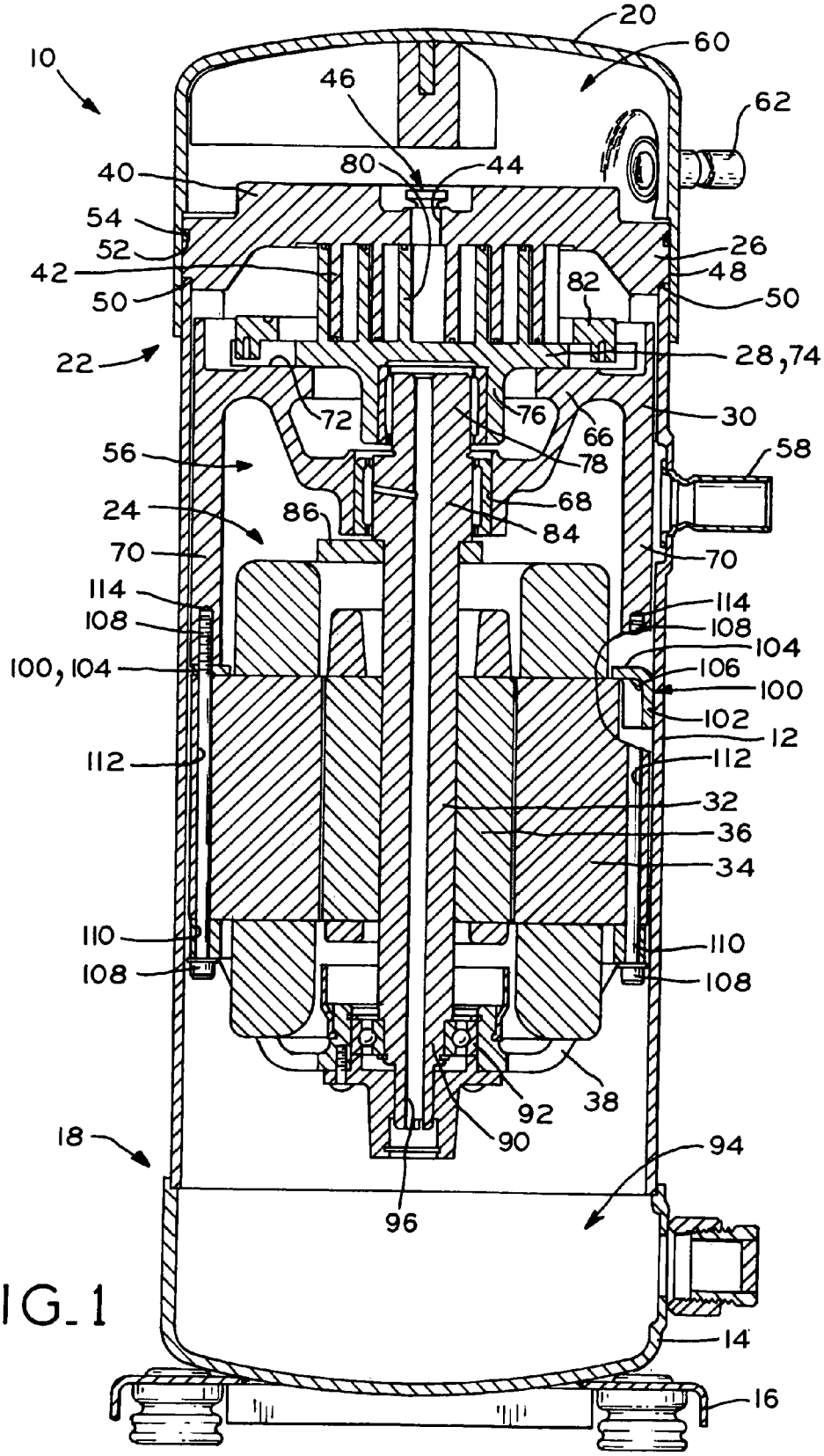
FIG. 1 is a vertical sectional view of a compressor including a motor-compressor unit mounting arrangement in accordance with the present invention, showing a portion of the motor-compressor unit cut away to illustrate portions of a mount bracket.
Figure 2:
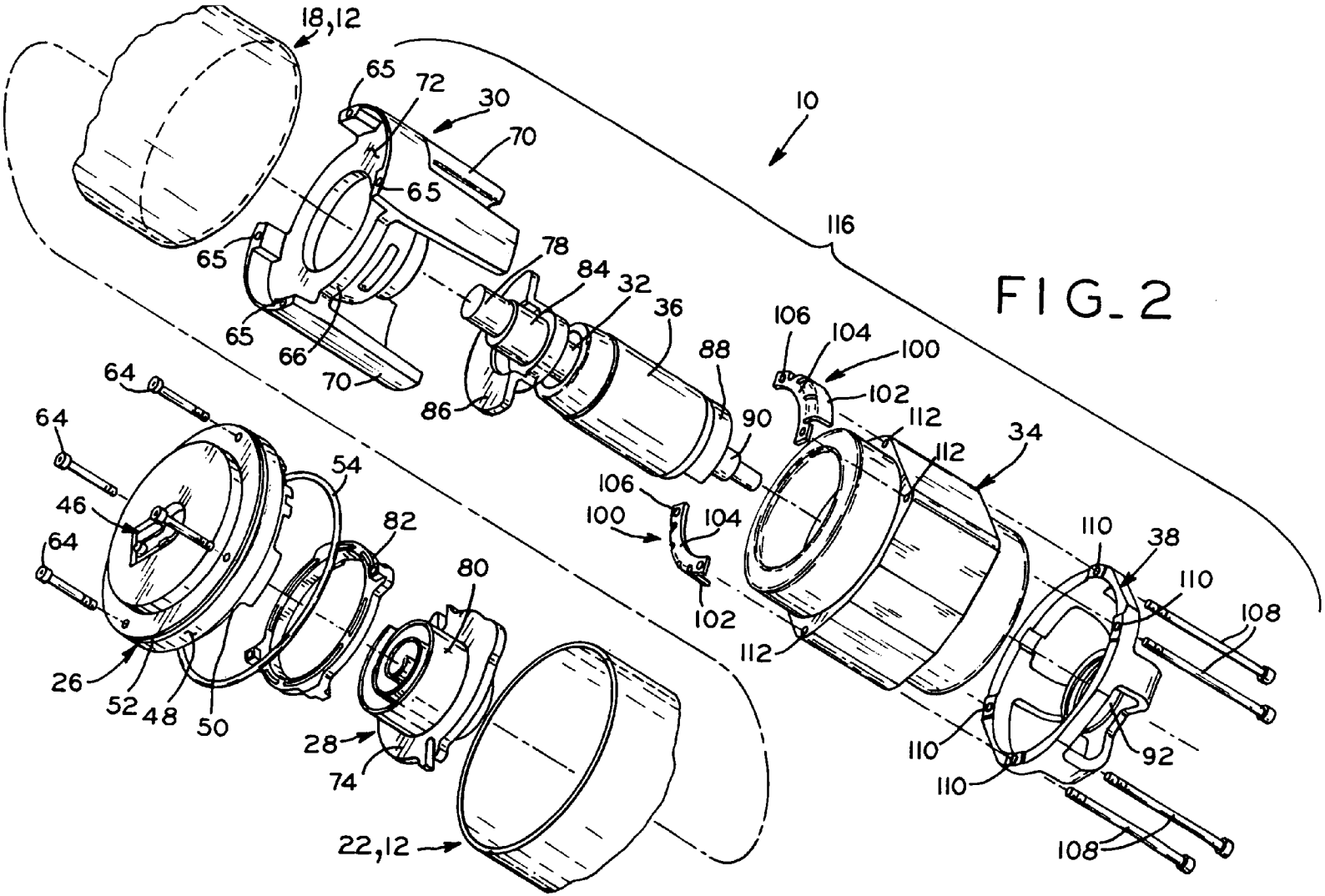
FIG. 2 is an exploded view of components of the compressor of FIG. 1.

Referring to FIGS. 1 and 2, scroll compressor 10 is shown, which includes a cylindrical main housing 12, bottom cap 14 with base 16 secured to a lower or first end 18 of housing 12, and top cap 20 secured to an upper or second end 22 of housing 12, each by a welding, brazing, or other suitable operation to thereby define an enclosed hermetic housing in which motor-compressor unit 24 of compressor 10 is disposed. Motor-compressor unit 24 generally includes a first, fixed scroll member 26, a second, orbiting scroll member 28, as well as crankcase 30, drive shaft 32, stator 34, rotor 36, outboard bearing assembly 38, and other components which are discussed below.

Motor-compressor unit 24 is mounted within housing 12 via a mounting arrangement in accordance with the present invention, which is described in further detail below. Although the mounting arrangement of the present invention is described herein with respect to an exemplary scroll compressor 10, the present mounting arrangement is also applicable to other compressors, such as reciprocating piston-type compressors and rotary vane compressors, for example. Also, although scroll compressor 10 is shown disposed vertically in FIG. 1, the present mounting arrangement may also be used in compressors, including scroll compressors, which are disposed horizontally.

Fixed scroll member 26 generally includes base plate 40 with involute wrap 42 extending therefrom, discharge port 44 fluidly communicating with the central portion of wrap 42, and discharge check valve assembly 46 mounted to base plate 40 over discharge port 44. Additionally, fixed scroll member 26 includes an outer peripheral surface 48 having an annular shoulder or flange 50 which is received over, and supported upon, the annular upper end 22 of housing 12. The open end of top cap 20 is received over the outer peripheral surface 48 of fixed scroll member 26 and upper end 22 of housing 12, and is welded thereto to secure the foregoing components together. In this manner, fixed scroll member 26 is fixedly mounted to housing 12 and top cap 20, and the weight of fixed scroll member 26 is supported by housing 12. Optionally, outer peripheral surface 48 of fixed scroll member 26 may include an annular groove 52 in which a compressive O-ring seal 54 is disposed to provide a more robust fluid seal between fixed scroll member 26 and top cap 20.

Fixed scroll member 26 divides the interior of housing 12 into a suction chamber 56, in which motor-compressor unit 22 is positioned, and which is in fluid communication with suction inlet port 58 of housing 12, and a discharge chamber 60, defined between fixed scroll member 26 and top cap 20, which is in fluid communication with discharge outlet port 62 of top cap 20. Fixed scroll member 26 is attached to crankcase 30 via a plurality of fasteners 64 (FIG. 2), such as threaded bolts, for example, which pass through bores in fixed scroll member 26 and are threaded into threaded holes 65 (FIG. 2) in crankcase 30. Alternatively, fasteners 64 may be inserted through bores in crankcase 30 and threaded into threaded holes in fixed scroll member 26. The weight of crankcase 30 is supported by fixed scroll member 26 via fasteners 64. Crankcase 30 includes main body portion 66 including a main bearing 68 (FIG. 1) for supporting an upper portion of drive shaft 32, and a plurality of legs 70 extend downwardly from main body portion 66. Crankcase 30 additionally includes a thrust bearing surface 72 for supporting orbiting scroll member 28.

Orbiting scroll member 28 includes base plate 74, an annular hub 76 extending from one side of base plate 74 which is drivably coupled to an eccentric end 78 of drive shaft 32, and an involute wrap 80 extending from an opposite side of base plate 74, which is in meshing engagement with wrap 42 of fixed scroll member 26. Oldham coupling 82 is coupled between fixed and orbiting scroll members 26 and 28 in a known manner, such as by first and second pairs of keys projecting from respective opposite sides of Oldham coupling 82, which are slidably engaged within slots or keyways in fixed and orbiting scroll members 26 and 28, respectively. Oldham coupling 82 functions in a known manner to prevent rotation of orbiting scroll member 28 and to confine the movement of orbiting scroll member 28 to orbital movement.

Drive shaft 32 includes upper portion 84 rotatably supported by main bearing 68 of crankcase 30, and eccentric end 78 of drive shaft 32 is drivably fitted within annular hub 76 of orbiting scroll member 26. Upper counterweight 86 is attached to upper portion 84 of drive shaft 32 via shrink fit or by suitable fasteners, for example, and balances the rotational moment of orbiting scroll member 28 during operation of compressor 10. Rotor 36 and drive shaft 32 are secured together via a shrink or interference fit, for example, and lower counterweight 88 (FIG. 2) is attached to rotor 36 via suitable fasteners, for example. Lower portion 90 of drive shaft 32 is rotatably supported by outboard bearing 92 carried by outboard bearing assembly 38, and is normally submerged within oil in oil sump 94 carried within the lower portion of housing 12. Drive shaft 32 includes oil passage 96 (FIG. 1) and, during rotation of drive shaft 32, a suitable oil pump or oil paddle (not shown) pumps oil upwardly through oil passage 96 of drive shaft 32 to lubricate main bearing 68 and the driving interface between eccentric end 78 of drive shaft 32 and annular hub 76 of orbiting scroll member 28.

A plurality of mount brackets 100, for example two mount brackets 100 as shown in FIGS. 1 and 2, are secured to the interior surface of housing 12 in the manner described below. Each mount bracket 100 is generally L-shaped, and includes first flange 102 secured to the interior surface of housing 12, and second flange 104 sandwiched between stator 34 and legs 70 of crankcase 30. Second flange 104 includes holes or openings 106 for receiving fasteners 108 via a close fit to secure outboard bearing assembly 38, stator 34, and crankcase 30 together in the manner described below. Although two mount brackets 100 and four fasteners 108 are shown in FIGS. 1 and 2, the number of mount brackets 100 and fasteners 108 which are used to mount motor-compressor unit 24 within housing 12 of compressor 10 may vary.

A plurality of fasteners 108 extend closely through holes 110 in outboard bearing assembly 38, through bores 112 in stator 34, and through holes 106 of mount brackets 100, and are threaded into threaded bores 114 in legs 70 of crankcase 30 to rigidly secure outboard bearing assembly 38, stator 34, mount brackets 100, and crankcase 30 to one another to form a stacked assembly, with stator 34 sandwiched between outboard bearing assembly 38 and mount brackets 100, and mount brackets 100 sandwiched between stator 34 and legs 70 of crankcase 30. In this manner, when compressor 10 is disposed vertically, the weight of stator 34 and outboard bearing assembly 38 is supported substantially entirely by crankcase 30, and the weight of crankcase 30 in turn is supported substantially entirely by fixed scroll member 26.

Additionally, the close fit between fasteners 108 and bores 112 of stator 34, and holes 106 of mount brackets 100 which are secured to housing 12, rigidly fixes the rotational position of stator 34 with housing 12 to counteract the rotational torque of the compressor motor during operation of compressor 10. Also, the attachment of mount brackets 100 to the interior surface of housing 12 prevents longitudinal movement of motor compressor unit 24 in a direction parallel to the long axis of compressor 10.

In operation of compressor 10, energization of stator 34 causes rotor 36 and drive shaft 32 to rotate within stator 34 in a known manner. Rotation of drive shaft 32 in turn drives orbiting scroll member 28 in an orbiting manner to define a plurality of variable-volume working pockets between wraps 80 and 42 of orbiting scroll member 28 and fixed scroll member 26, respectively. Working fluid at suction pressure within suction chamber 56 is drawn into the working pockets defined between the wraps of orbiting and fixed scroll members 28 and 26 and is compressed with the working pockets. The compressed working fluid is discharged through discharge port 44 of fixed scroll member 26 and discharge check valve assembly 46 into discharge chamber 60 at discharge pressure, and thereafter passes through discharge outlet port 62 of compressor 10 into a refrigeration system (not shown).

In another exemplary embodiment, shown in FIGS. 3-7, an alternate design of compressor 10 is depicted as compressor 10' and includes mount brackets 100'. For clarity, several components of compressor 10', such as components of motor-compressor unit 24, are not depicted in FIGS. 3 and 4. However, compressor 10' is assembled and operates in a manner substantially similar to that described herein with respect to compressor 10 and identical reference numerals have been used to identify identical or substantially identical components therebetween.

Figure 3:
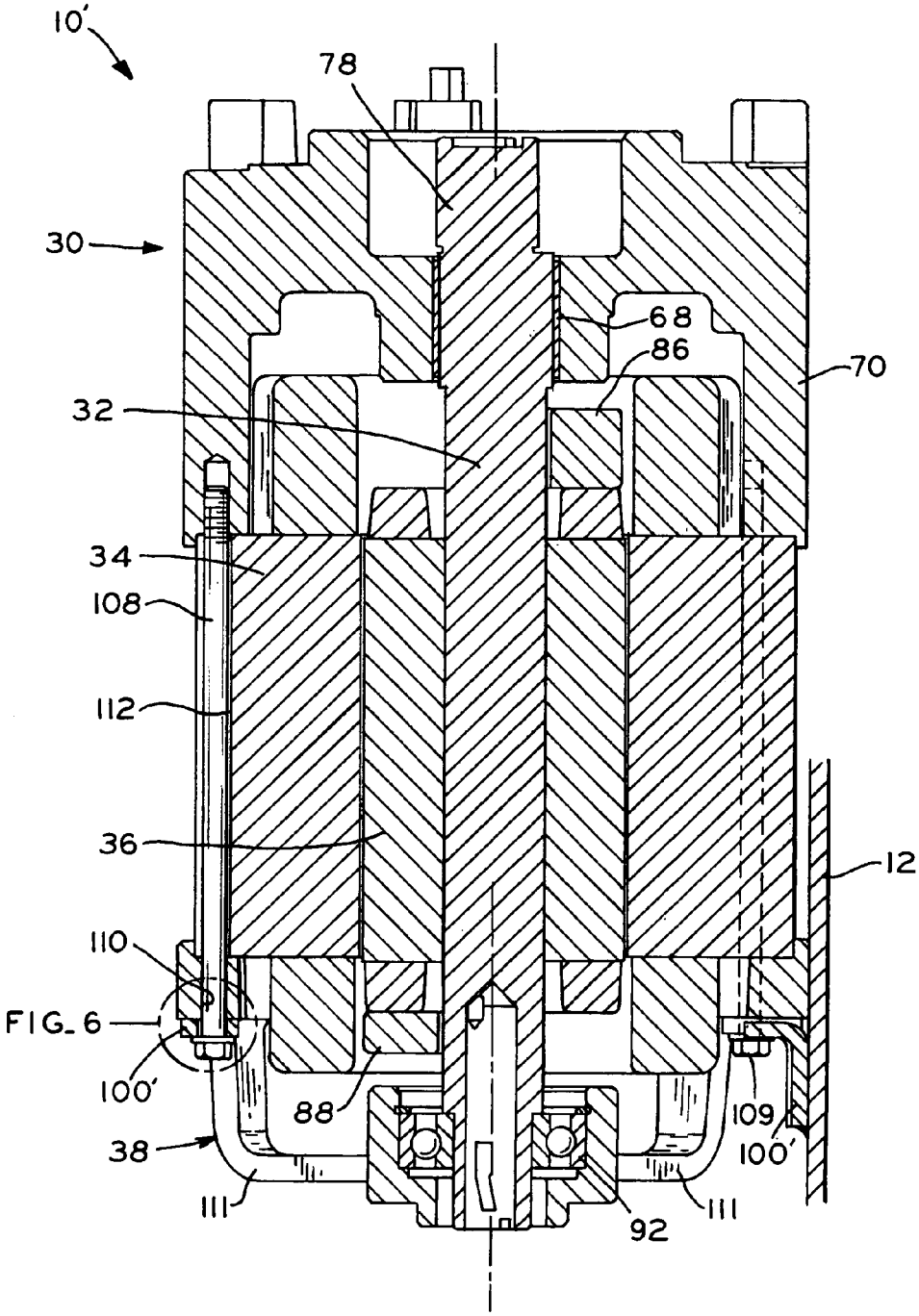
FIG. 3 is an vertical, fragmentary sectional view of a compressor including a motor-compressor unit mounting arrangement according to another embodiment of the present invention taken along line 3-3 of FIG. 5.
Figure 4:
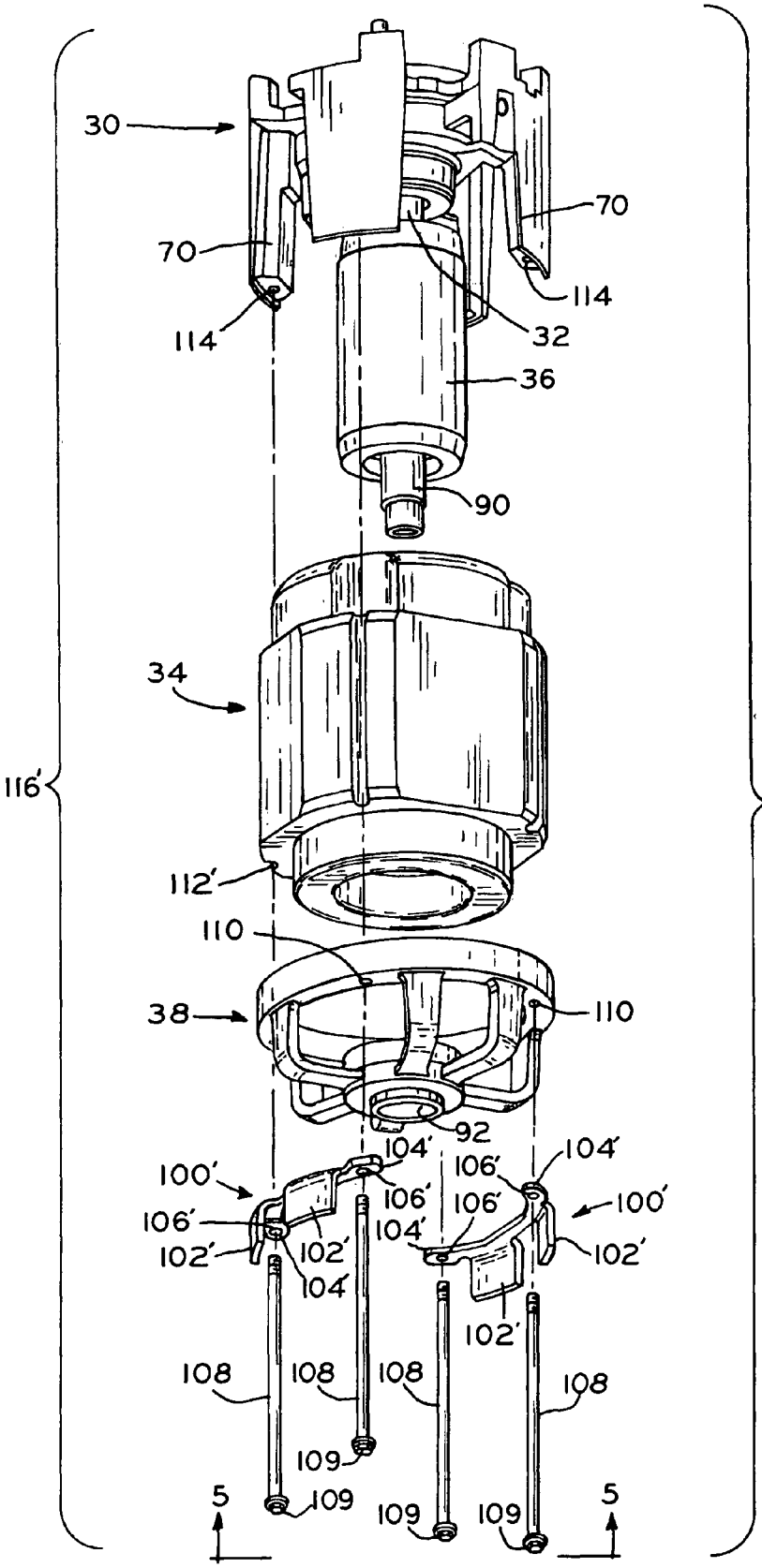
FIG. 4 is an exploded view of components of the compressor of FIG. 3.

Referring to FIGS. 3 and 4, mount brackets 100' of compressor 10' are secured to an underneath side of the annular portion outboard bearing assembly 38, allowing mount brackets 100' to carry out the same function as mount brackets 100 described above. A plurality of mount brackets 100', for example two mount brackets 100' as shown in FIGS. 3 and 4, are secured to the interior surface of housing 12, as described in detail below. Each mount bracket 100 has a generally arcuate, L-shape, and includes first flanges 102' secured to the interior surface of housing 12 and second flanges 104' sandwiched between outboard bearing assembly 38 and heads 109 of fasteners 108.

Figure 5:
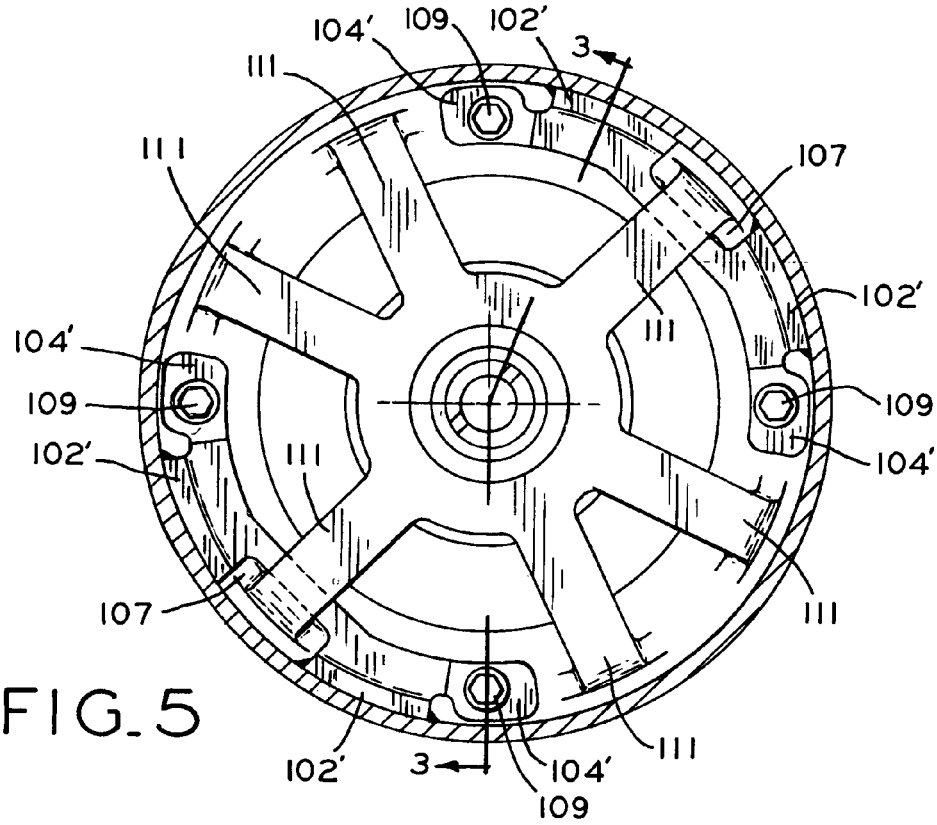
FIG. 5 is a plan view of the compressor of FIG. 3 taken in the direction of arrows 5-5 of FIG. 4.

First flanges 102' of mount brackets 100' are separated from one another by gap 107. As shown in FIG. 5, gap 107 is sized and configured to receive one of support arms 111 of outboard bearing assembly 38. Advantageously, the design of mount bracket 100' allows for the removal, attachment, and/or adjustment of the same after the components of subassembly 116 have been secured to one another. Specifically, the inclusion of gap 107 allows for mount brackets 100' to be slid around support arms 111 for removal or attachment to subassembly 116. In another exemplary embodiment, mount brackets 100' include a larger gap 107 sized to receive a plurality of support arms 111 therein. Additionally, second flanges 104' of mount bracket 100' include holes or openings 106' for receiving fasteners 108 to secure outboard bearing assembly 38, stator 34, and crankcase 30 together in the manner described below. Although two mount brackets 100' and four fasteners 108 are shown in FIGS. 3-5. the number of mount brackets 100' and fasteners 108 which are used to mount subassembly 116' within housing 12 of compressor 10' may vary.

A plurality of fasteners 108 extend loosely through holes 106' in mount brackets 100' and closely through holes 110 in outboard bearing assembly 38 and open bores 112' in stator 34, and are threaded into threaded bores 114 in legs 70 of crankcase 30 to rigidly secure mount brackets 100', outboard bearing assembly 38, stator 34, and crankcase 30 to one another. In this manner, outboard bearing assembly 38 is sandwiched between stator 34 and mount brackets 100', and mount brackets 100' are sandwiched between outboard bearing assembly 38 and heads 109 of fasteners 108. Advantageously, by positioning mount brackets 100' as described above, i.e., exterior of outboard bearing assembly 38, the overall alignment and positioning of outboard bearing assembly 38, stator 34, and crankcase 30 are not affected by the alignment, position, or dimensions of mount brackets 100'. In other words, any variations in the size or configuration of mount brackets 100' will not result in corresponding variations in the alignment or position of outboard bearing assembly 38, stator 34, and crankcase 30 relative to one another. As a result, mount brackets 100' do not have be to manufactured to a high tolerance, lessening the cost of manufacturing mount brackets 100'.

Figure 6:
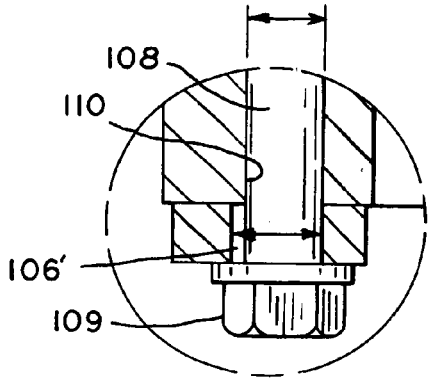
FIG. 6 is an enlarged fragmentary view of a portion of FIG. 3.
Figure 7:
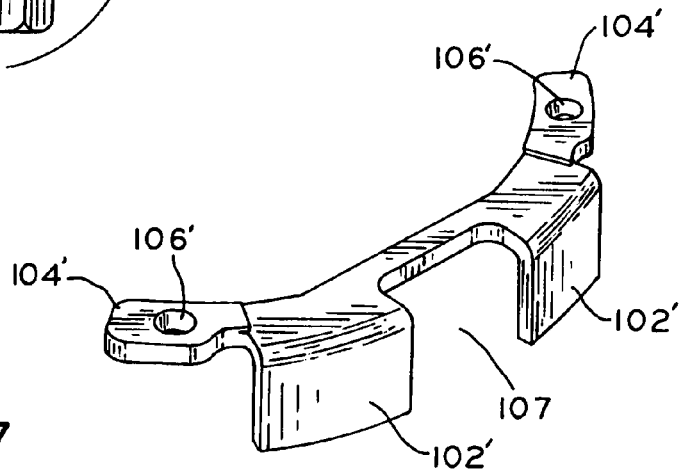
FIG. 7 is a perspective view of the mount bracket of FIGS. 3-6.

Additionally, the loose fit between fasteners 108 and bores 106' of mount bracket 100' allows for adjustment of the position of mount bracket 100' relative to outboard bearing 38, stator 34, and crankcase 30, which are rigidly fixed together as described in detail above. Specifically, as shown in FIG. 6, openings 106' extending through mount brackets 100' are larger than the shafts of fasteners 108, while openings 110 extending through stator 34, for example, are sized to engage the exterior of the shafts of fasteners 108 to rigidly fix the components together. Advantageously, this loose fit connection allows for the position of outboard bearing assembly 38, stator 34, and crankcase 30 to be adjusted within housing 12. Specifically, by loosening fasteners 108, fasteners 108 and, correspondingly, outboard bearing 38, stator 34, and crankcase 30 can be moved relative to mount brackets 100' within the limits of openings 106'. Fasteners 108 can then be tightened and outboard bearing assembly 38, stator 34, and crankcase 30 secured in the desired position.

Referring to FIGS. 2 and 4, an exemplary method of assembling compressors 10, 10' in accordance with the above-described mounting arrangements for motor compressor unit 24 will now be described. However, one of ordinary skill in the art will appreciate that some modifications to the assembly method described below are possible. Advantageously, as shown in FIGS. 2 and 4, motor-compressor unit subassembly 116, which includes outboard bearing assembly 38, stator 34, mount brackets 100, 100' (FIGS. 2 and 4, respectively), and crankcase 30, may be assembled externally of housing 12 by securing outboard bearing assembly 38, stator 34, mount brackets 100, 100', and crankcase 30 to one another with fasteners 108 in the manners described above and depicted in FIGS. 2 and 4. Additionally, drive shaft 32 and rotor 36 may also be assembled to the foregoing subassembly 116.

Subassembly 116 is then inserted into either the lower end 18 or the upper end 22 of housing 12. Thereafter, mount brackets 100, 100' are secured to housing 12 by welding from externally of housing 12, such as by projection welding. In another exemplary embodiment, the welding of mount brackets 100' to housing 12 incurs internally of housing 12. Additionally, if mount brackets 100' are utilized, housing 12 may be shrink-fit to subassembly 116 prior to welding mount brackets 100' to housing 12. Further, the proximity of mount brackets 100' (FIG. 3) to the bottom of housing 12 (FIG. 1) allows for any welding slag to fall from of housing 12, eliminating the need for removal of the same. Once welded to housing 12, mount brackets 100, 100' prevent rotation of subassembly 116 about the axis of crankshaft 32. Specifically, during operation of compressors 10, 10', significant torque may be generated by motor-compressor unit 24, which could cause rotation of subassembly 116. However, by utilizing mount brackets 100, 100', any rotation of subassembly 116 resulting from the operation of compressors 10, 10', respectively, is prevented.

The remaining components of motor-compressor unit 24, including orbiting scroll member 28, Oldham coupling 80, and fixed scroll member 28, are then assembled into housing 12 from upper end 22 of housing 12, with fasteners 64 securing fixed scroll member 26 to crankcase 30. Finally, bottom and top caps 14 and 20 are secured to housing 12 by a suitable welding or brazing operation to complete the assembly of compressors 10, 10'.

Alternatively, fixed scroll member 26 may be either fixedly secured to, or supported by, the upper end 22 of housing 12 in the manner described above, followed by inserting subassembly 116 into lower end 18 of housing 12 and securing mount brackets 100, 100' to the interior surface of housing 12 and fixing crankcase 30 to fixed scroll member 26 by fasteners 64, followed by securing top and bottom caps 14 and 20 to housing 12.

Additionally, referring to FIG. 6, mount brackets 100' allow for adjustment of the position of subassembly 116, even after mount brackets 100' are secured to housing 12. Specifically, as described in detail above, the loose fit connection between the shaft of fastener 108 and opening 106' in mount bracket 100' allows for the position of subassembly 116 to adjusted. This helps lessen the needed for precise alignment during assembly and decreases manufacturing costs by eliminating the need for precise tolerances amongst the components of subassembly 116.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor, comprising:

an outer housing;

a motor including a stator having a stack height and a rotor, said motor positioned within said housing;

a crankcase one of directly and indirectly fixedly connected to said housing;

an outboard bearing assembly positioned within said housing;

a drive shaft assembly disposed within said rotor, one end of said drive shaft rotatably supported by said crankcase and an opposite end of said drive shaft rotatably supported by said outboard bearing assembly;

at least one mount bracket secured to an interior surface of said housing, said mount bracket positioned adjacent said outboard bearing assembly such that said mount bracket is much closer to said outboard bearing assembly than said stator stack height; and at least one fastener connecting together said outboard bearing assembly, said stator and said crankcase to form a stacked assembly comprising said crankcase, stator and outboard bearing assembly, said fastener also extending through said at least one mount bracket whereby said mount bracket rotationally fixes the position of said stator;

said mount bracket being disposed axially exteriorly of said stacked assembly.

2. The compressor of claim 1, further comprising a plurality of said mount brackets secured to said interior surface of said housing in spaced relationship with respect to one another, and a plurality of said fasteners connecting said outboard bearing assembly and said stator and extending through said outboard bearing assembly and respective said mount brackets.

3. The compressor of claim 2, wherein said mount brackets are captured directly between said outboard bearing assembly and said fasteners.

4. The compressor of claim 2, wherein said crankcase includes a body portion with a plurality of legs extending therefrom, said plurality of fasteners secured to respective said legs.

5. The compressor of claim 1, wherein said compressor is a scroll compressor, further comprising:

a first scroll member fixedly connected to said housing and including a base plate and a first wrap extending from said base plate; and a second scroll member coupled to said drive shaft for orbital movement, said second scroll member including a second wrap intermeshed with said first wrap.

6. The compressor of claim 1, wherein said mount bracket is in contact with said outboard bearing assembly.

* * * * *